US009132996B2

(12) United States Patent
Robertson

(10) Patent No.: US 9,132,996 B2
(45) Date of Patent: Sep. 15, 2015

(54) CRANE-MOUNTED GRAB HEAD

(71) Applicant: Terrafirma Roadways Limited, Oxford (GB)

(72) Inventor: Hugh Stewart Robertson, Oxford (GB)

(73) Assignee: Newpark Mats & Integrated Services LLC, The Woodlands, TX (US)

( * ) Notice: Subject to any disclaimer, the term of this patent is extended or adjusted under 35 U.S.C. 154(b) by 0 days.

(21) Appl. No.: 14/181,311

(22) Filed: Feb. 14, 2014

(65) Prior Publication Data

US 2014/0232127 A1 Aug. 21, 2014

(30) Foreign Application Priority Data

Feb. 18, 2013 (GB) ..... 1302745.3

(51) Int. Cl.

| | |
|---|---|
| ***B66C 1/66*** | (2006.01) |
| ***B66C 1/44*** | (2006.01) |
| ***B66C 13/46*** | (2006.01) |
| ***E01C 19/52*** | (2006.01) |

(52) U.S. Cl.

CPC . *B66C 1/44* (2013.01); *B66C 1/447* (2013.01); *B66C 1/66* (2013.01); *B66C 13/46* (2013.01); *E01C 19/52* (2013.01)

(58) Field of Classification Search

CPC ..... B66C 1/28; B66C 1/30; B66C 1/32; B66C 1/427; B66C 1/447; B66C 1/44; B66C 1/66; B66C 13/46; B66F 9/186; E01C 19/52

USPC ..... 294/67.33, 81.21, 81.54, 81.62, 207

See application file for complete search history.

(56) References Cited

U.S. PATENT DOCUMENTS

| | | | | | |
|---|---|---|---|---|---|
| 3,750,814 | A | * | 8/1973 | Allegri et al. | 294/81.21 |
| 3,905,632 | A | * | 9/1975 | Caylor et al. | 294/119.1 |
| 4,051,966 | A | * | 10/1977 | Cotton | 414/428 |
| 4,252,358 | A | | 2/1981 | Klebs | |
| 4,563,031 | A | * | 1/1986 | Kishimoto et al. | 294/81.21 |
| 4,715,762 | A | * | 12/1987 | Lanigan et al. | 414/798.1 |
| 4,973,094 | A | * | 11/1990 | Tana et al. | 294/81.21 |
| 5,370,435 | A | * | 12/1994 | Monk et al. | 294/81.54 |
| 5,431,471 | A | * | 7/1995 | Baumann | 294/68.3 |
| 6,471,274 | B1 | * | 10/2002 | Nerger | 294/81.54 |

FOREIGN PATENT DOCUMENTS

| | | | |
|---|---|---|---|
| CA | 2375960 | A1 | 3/2002 |
| DE | 4107493 | A1 | 9/1992 |
| DE | 202006004889 | U1 | 6/2006 |
| EP | 1101869 | A1 | 5/2001 |

OTHER PUBLICATIONS

"Terrafirma Roadways Method Statement for laying Dura Base Mats with truck mounted Epsilon crane", H. Robertson, Terrafirma Roadways, Nov. 14, 2011, 10 pp.

* cited by examiner

*Primary Examiner* — Dean Kramer

(74) *Attorney, Agent, or Firm* — E. Randall Smith; Jones & Smith, LLP

(57) ABSTRACT

System for assembling a temporary surface includes a grab head and a plurality of mats configured to be placed on the ground and interconnected to form the temporary surface. The grab head includes first and second opposing jaws, each jaw having first and second spaced-apart teeth. Each tooth includes at least one flange and is engageable with one among a series of holes formed in one of the mats.

19 Claims, 5 Drawing Sheets

CRANE-MOUNTED GRAB HEAD

FIELD OF THE INVENTION

The present invention is directed towards a crane grab head for picking up floor mats.

BACKGROUND OF THE INVENTION

In situations where vehicular or pedestrian access is required on certain plots of land, for instance arable land, road or floor mats are often laid to act as a temporary surface to prevent damage to this underlying land.

The floor mats used are generally modular and are usually inserted into position by the use of a crane.

An example floor mat used is the DURA-BASE™ mat by Terrafirma Roadways. A perspective view of this mat is shown in FIG. 1A. The mat is formed of two overlapping rectangular sections. Holes extend around the perimeter of the mat along the non-overlapping portions of the two sections. When two of these mats are placed next to each other, the mats overlap and the holes along the common edge of these two mats line up such that a temporary locking pin can be placed through the holes of both mats to secure the two mats together.

Given their shape and size, handling and placing these mats into position has proved difficult.

One method which has been used has chains which anchor to the four corners of the mat. The chains then connect to a crane arm which lifts the mat. The problem with this lifting method is that the chains are flexible making accurate manoeuvring and placing of the mat difficult.

Alternatively, the mat has been placed onto a forklift. When in the correct position, the forklift operator angles the rails of the forklift downward causing the mat to slide off into position. The method is slow and can cause damage to the mats as they are positioned.

An improved method for lifting these mats involves a grab device from Terrafirma which allows mats, such as DURA-BASE™ mats, to be gripped, lifted, and placed into position. The present invention relates to improvements to this grab device.

SUMMARY OF THE INVENTION

According to one aspect of the present embodiment, there is provided a crane grab head comprising a pair of jaws, a power source for moving the jaws, and a connector for connecting the grab head to a crane, wherein each jaw comprises at least one tooth for engaging with an object;

- wherein each jaw is driven by a respective hydraulic/pneumatic cylinder which is slideable linearly to move the jaws between open and closed positions;
- wherein the width of the grab head measured between the extremities of the jaws in the closed position is more than 1500 mm; and
- wherein the separation between a horizontal plane passing through the top of the uppermost cylinder when the head is held freely in normal use and a parallel plane passing through the lowermost edge of the lowermost tooth is less than 250 mm.

The defined separation of this embodiment essentially represents the maximum height of the grab head excluding the connector. By minimizing this separation, the bending moment applied to each tooth when the grab grips a mat is reduced. Reducing the bending moment reduces the chance of each tooth breaking during the gripping process, and thus increases the number of mats which can be positioned by the grab head before a tooth fails. This is of particular importance considering each tooth may be cyclically loaded between a gripping position and a non-gripping position hundreds of times a day.

Also keeping the vertical separation to less than 250 mm allows the grab head of this embodiment to be more conveniently stowed when it is not in use.

The teeth on both jaws of this embodiment may be level with one another. However, preferably the separation on one side is greater than the separation on the other.

This may be achieved, for example, either by offsetting the cylinders for the two jaws, or by having the jaws and/or teeth on one side larger than the other.

The offsetting of the teeth between the two jaws in the grab head means that teeth on one jaw are lower than those on the other. This allows the grab head to pick up objects which are not necessarily flat or which are stepped; for instance a DURA-BASE™ mat, while still maintaining the resultant closing force on the jaws generally in line with the cylinders.

The hydraulic/pneumatic cylinders may be arranged to pull together and push apart the pairs of jaws with equal force either way. This capability of the jaws to grip by either pulling and pushing means that the grab head can be used with much greater flexibility and allows the grab head to separate two mats by pulling them apart in a generally horizontal plane. Existing grab heads are not designed to do this and attempts to do so have resulted in premature breakage of the grab head.

According to a second aspect of the present embodiment invention, there is provided a crane grab head comprising a pair of jaws, a power source for moving the jaws, and a connector for connecting the grab head to a crane, wherein each jaw comprises at least one tooth for engaging with an object;

- wherein each jaw is driven by a respective hydraulic/pneumatic cylinder which is slideable linearly to move the jaws between open and closed positions;
- wherein the width of the grab head measure between the extremities of the jaws in the closed position is more than 1500 mm; and
- wherein the tooth/teeth of the first jaw are spaced further beneath the cylinders when the head is held freely in normal use than are the tooth/teeth of the other jaw.

As previously described, the offsetting of the teeth between the two jaws in the grab head allows it to pick up objects which are not necessarily flat or which are stepped; for instance a DURA-BASE™ mat, while still maintaining the resultant closing force on the jaws generally in line with the cylinders.

At least one of the pair of jaws may comprise a visual indication which allows the pair of jaws to be distinguished from each other. The visual indication may be the fact that one jaw is coloured differently than the other jaw.

According to a third aspect of the present embodiment, there is provided a crane grab head comprising a pair of jaws, a power source for moving the jaws, and a connector for connecting the grab head to a crane, wherein each jaw comprises at least one tooth for engaging with an object;

- wherein each jaw is driven by a respective hydraulic/pneumatic cylinder which is slideable linearly to move the jaws between open and closed positions;
- wherein the width of the grab measured between the extremities of the jaws in the closed position is more than 1500 mm; and
- wherein the pneumatic/hydraulic cylinders are arranged to pull together and push apart the pairs of jaws with equal force either way.

The ability of the grab head to push apart the pairs of jaws allows it to separate two mats in a manner not possible with the prior art described above.

Each jaw may comprise more than one tooth. By increasing the number of teeth present in the grab head, the pressure acting on each tooth by the power source is reduced.

Each tooth preferably comprises a step which extends for less than 15 mm in the direction toward the other jaw, and which is configured to grip a complimentary shoulder of an object.

The cylinders each may have a sold circular cross section. This cross section is preferable to the square cross section currently employed as it reduces the friction losses present in each cylinder. Reducing the friction in each cylinder contributes to the grab head having a low profile since the reduced friction allows the cross sectional width of each cylinder to be reduced.

The grab head may be provided in conjunction with a jaw adaptor which is fastened to one of the jaws, wherein the jaw adaptor comprises at least one auxiliary tooth to take over the role of the tooth/teeth of the jaw to which the adaptor is fastened, such that the adaptor allows the separation between the auxiliary tooth/teeth and the tooth/teeth of the other jaw to be changed as compared to the separation between the tooth/teeth on the jaws without the adaptor in place. The grab head may be provided in conjunction with a floor element wherein the teeth are configured to grip the floor element. The floor element may be in particular a DURA-BASE™ mat.

BRIEF DESCRIPTION OF THE DRAWINGS

An example of an apparatus in accordance with the present invention will now be described with reference to the accompanying drawings, in which.

DETAILED DESCRIPTION OF THE PREFERRED EMBODIMENTS

Figure 1A:
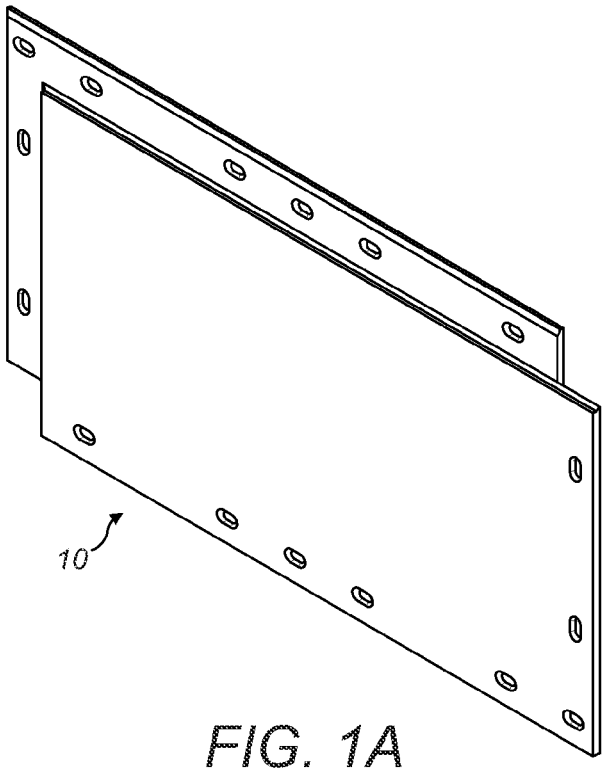
FIG. 1A shows a perspective view of an example DURA-BASE™ floor mat.
Figure 1B:
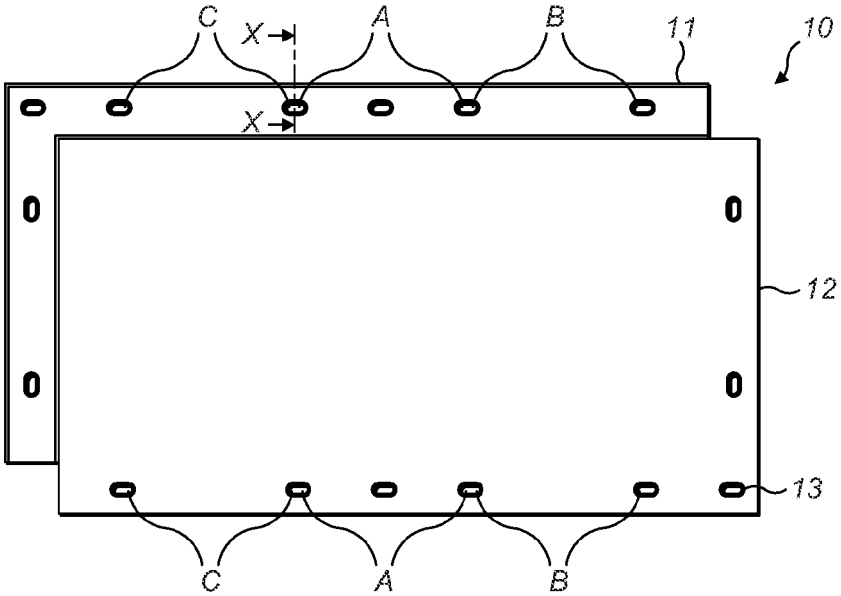
FIG. 1B shows a plan view of the mat.
Figure 1C:
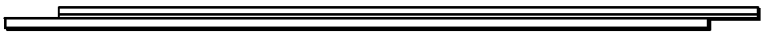
FIG. 1C shows a side view of the mat.

FIGS. 1A-1C show views of an example floor mat 10, or floor element, which the grab head of the present embodiment is designed to grip. The mat 10 is formed of a top and bottom sheet of material 11;12 which overlap each other.

Each exemplary mat 10 or sheet of material 11;12 is formed of any appropriate material that can withstand the load of a vehicle passing over it. Preferably each mat can support a load weight of 40 tonnes/$m^3$. The mat 10 has a density less than that of water so that it can float on water when loaded less than 250 kg.

Figure 3:
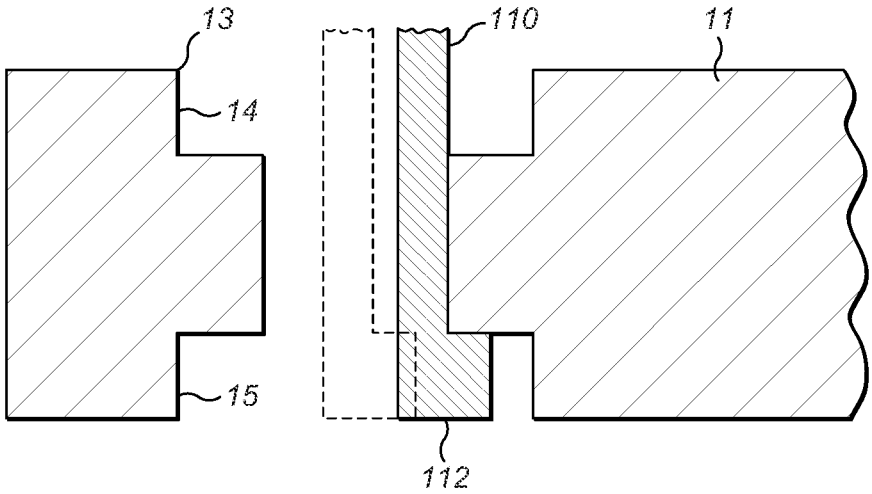
FIG. 3 shows a detailed cross section view of the mat taken across the plane X-X from FIG. 1B when the exemplary crane grab head is grabbing the mat.

The two sheets 11;12 of the mat 10 are slightly displaced horizontally and laterally from one another such that only the top sheet 11 is present along two neighbouring sides of the mat 10, and only the bottom sheet 12 is present along the remaining two sides of the mat 10.

Where the two sheets 11;12 do not overlap, a number of holes 13 extend through the projections of sheets 11;12. The cross section of each of these holes 13 is shown in FIG. 3. The distance between the holes may be fixed to a certain spacing so that the holes 13 form hole sets, for example A-A; B-B; and C-C as shown in FIG. 1A. As will be described, these sets are exemplary points where the exemplary grab head picks up the mat 10.

As shown in FIG. 3, a top and bottom ridge 14;15 extends around the top and bottom edges of each hole 13.

Figure 2A:
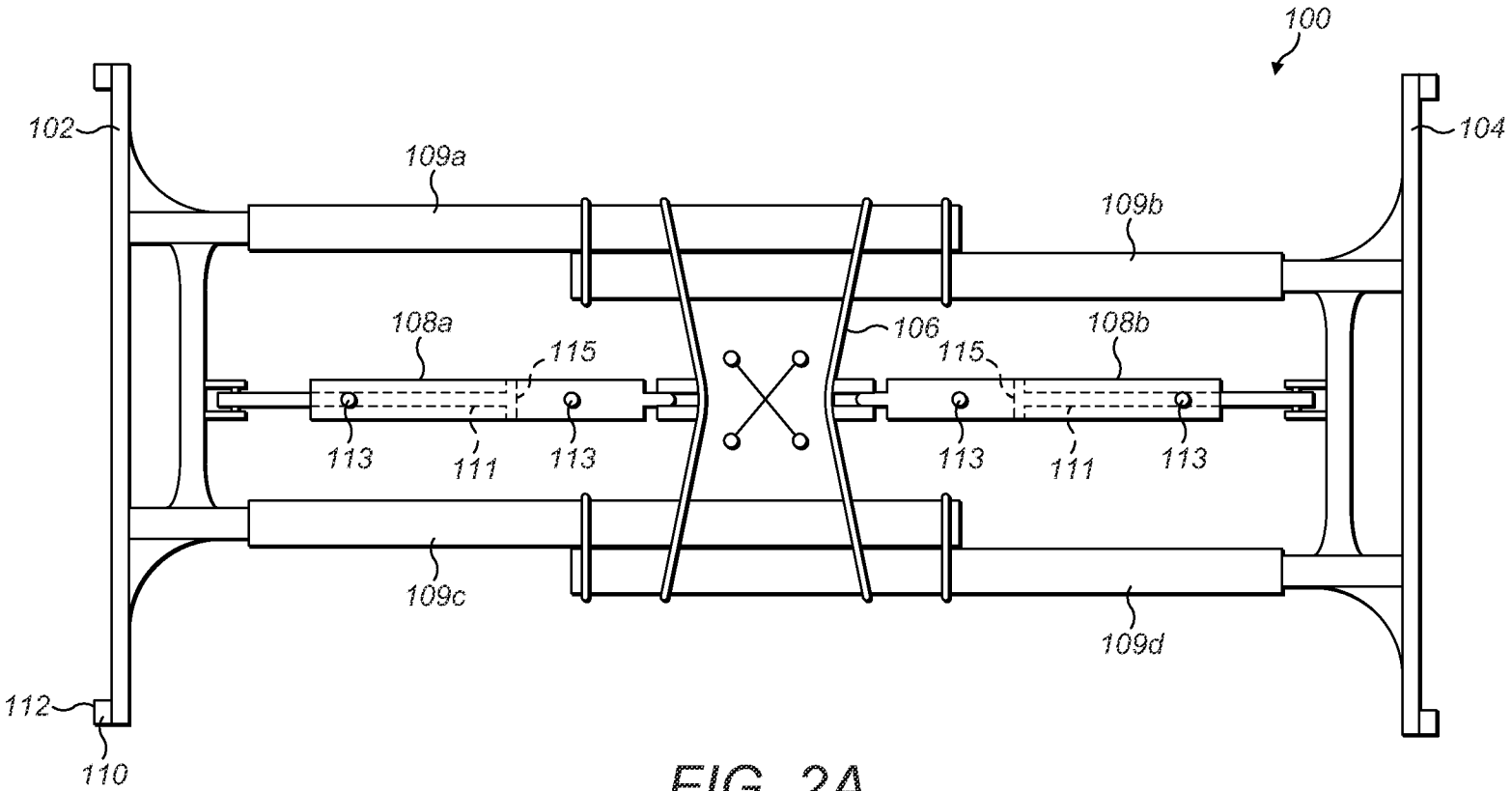
FIG. 2A shows a plan view of an embodiment of a crane grab head according to the present invention.
Figure 2B:
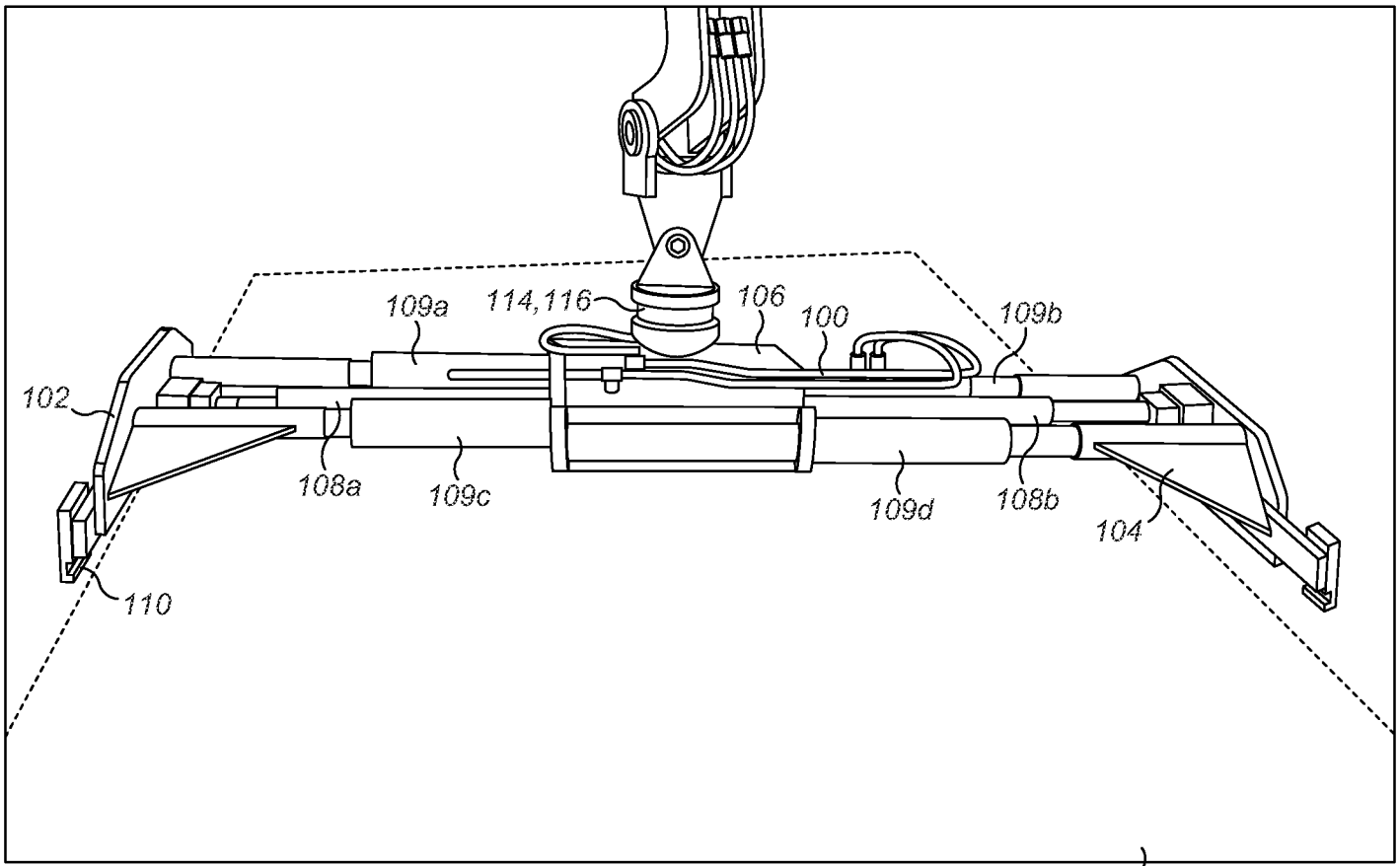
FIGS. 2B and 2C show perspective views of this crane grab head.
Figure 2C:
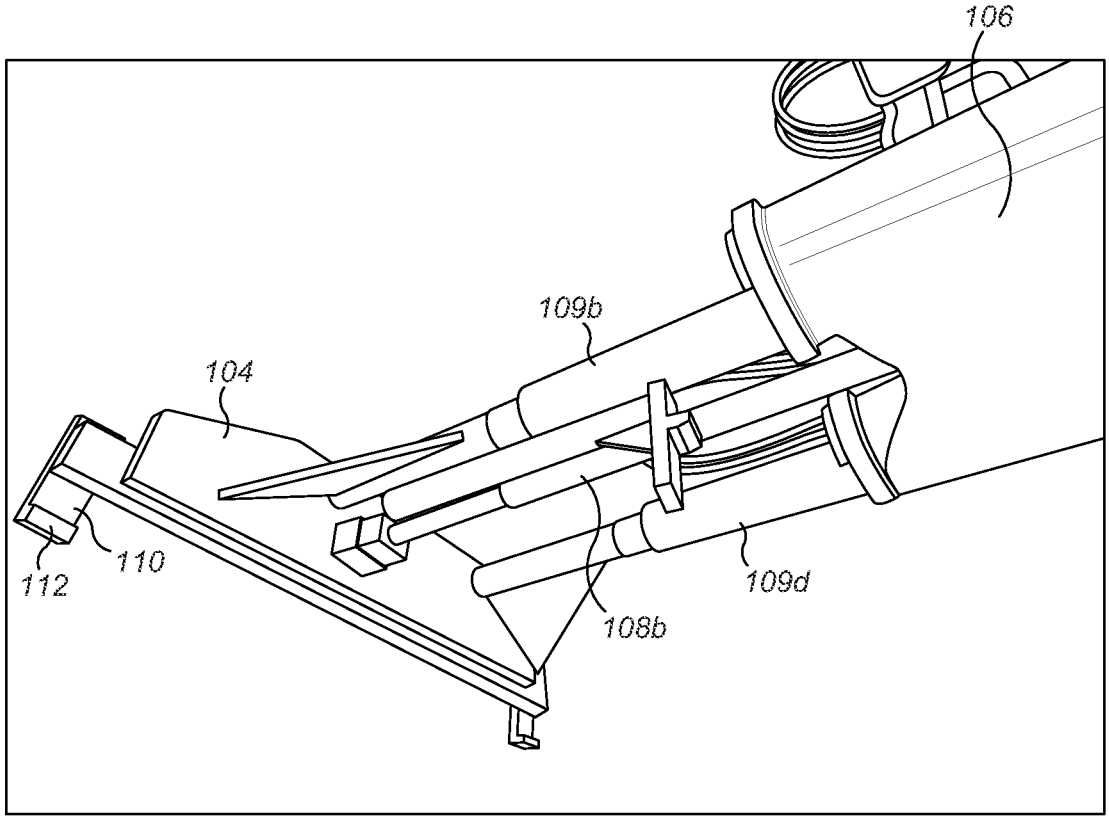

To lift the mat 10, the exemplary crane grab head 100 as shown in FIGS. 2A-C is used. The crane grab head 100 is formed of first and second jaws 102;104 which connect to a central portion 106 via hydraulics or pneumatic actuation cylinders 108*a*;108*b* and telescopic supports 109*a-d*. Each illustrated cylinder and support comprises a rod which slides between an open and closed position. The cylinders 108*a*; 108*b* are coplanar and are orientated parallel with each other. The supports 109*a-d* are also coplanar and are orientated parallel with each other.

In this embodiment, the first and second jaws 102;104 each comprise two teeth 110. Each tooth 110 extends downwardly from the jaw and terminates with a flange 112 which extends in the direction toward the other jaw. The extension of the flange towards the other jaw is preferably less than 15 mm in length, though is more preferably 12 mm.

Although the teeth 110 on each jaw 102;104 are shaped the same and have the same dimensions, the teeth 110 on the first jaw are located closer to the cylinders than are the teeth 110 on the second jaw. The difference in height between the two sets of teeth may be approximately 50 mm. To help the crane operator identify which jaw has the higher set of teeth, and thus identify which is the first jaw, the first jaw comprises a highly visible indication positioned at the top of the jaw. The indication may be in that the first jaw is a different colour to that of the second jaw.

Each of the two jaws is connected to the central portion of the crane grab head by one of the two actuation cylinders 108*a*;108*b* and two of the four supports 109*a-d*. Two of the supports 109*a*;109*c* connect the central portion 106 to the first jaw 102, whilst the remaining two supports 109*b*;109*d* connect the central portion 106 to the second jaw 104. To provide maximum support to the exemplary jaws whilst they are being moved, the two supports on each jaw are located on either side of the actuation cylinder for the jaw, which is more centrally located on the jaw.

Each of the two exemplary actuation cylinders 108*a*;108*b* operates in a telescopic fashion such that the distance between each jaw and the central portion can be varied. Each of the cylinders 108*a*;108*b* may also be configured as a double acting ram 111 to allow either a pulling or pushing force to be applied. In this case, each cylinder 108*a*;108*b* comprises a hydraulic/pneumatic port 113 on either side of the ram head 115 to allow it to move both ways.

At the top of the exemplary central portion 106 is a servomotor or stepper-motor 114 in combination with a pivot joint 116 which allows the grab head to be connected to the remaining part of the crane and also rotated and angled as needed. Electrical connections and pressure lines from the grab head also connect to the remaining part of the crane via the central portion 106.

An equalizer valve may be used to distribute fluid pressure from a hydraulic/pneumatic pressure source on the crane to each of the cylinders 108*a*;108*b* on the grab head. From the equalizer valve, any conventional hydraulic/pneumatic pressure system can be used to control operation of the double acting ram in each cylinder.

The vertical separation between the bottom of the lowermost tooth/teeth of the exemplary grab head and the top of the cylinders is preferably as small as possible to ensure ease of stowage and minimize the bending moment exerted on each tooth when they are gripping an object. In the embodiment shown in FIGS. 2A-C, the separation between a horizontal plane passing through the top of the uppermost cylinders when the head is held freely in normal use and a parallel plane passing through the lowermost edge of the lowermost tooth is less than 250 mm.

Operation of the exemplary crane grab head is shown best with reference to FIG. 1A and FIG. 3. As previously described, the mat 10 comprises a series of hole sets A-A; B-B; and C-C. The separation between the holes in each sheet from these sets is the same. The separation and size of each hole in each set is also such to allow the two teeth from each jaw of the crane grab head to pass through all the holes in the set.

Taking the example of the four holes indicated by hole set A-A, in use the crane operator initially orientates the exemplary crane grab head, via the stepper-motor 114 and the pivot joint 116, and spaces the jaws, via the cylinders 108*a*;108*b*, such that the teeth from the first jaw are positioned over the two holes from the hole set which are located on the top sheet 11 and the teeth from the second jaw are positioned over the remaining two holes from the hole set located on the bottom sheet 12.

The crane operator then lowers the exemplary crane grab head such that the teeth enter the holes A-A of the mat into the dotted position as shown in FIG. 3. In this embodiment, in situations where the mat 10 is placed flat on the ground, the operator will know when the teeth are in the dotted position shown in FIG. 3 since he will feel resistance in the movement controls of the crane due to the bottom of the teeth in the second jaw making contact with the ground.

Figure 4:
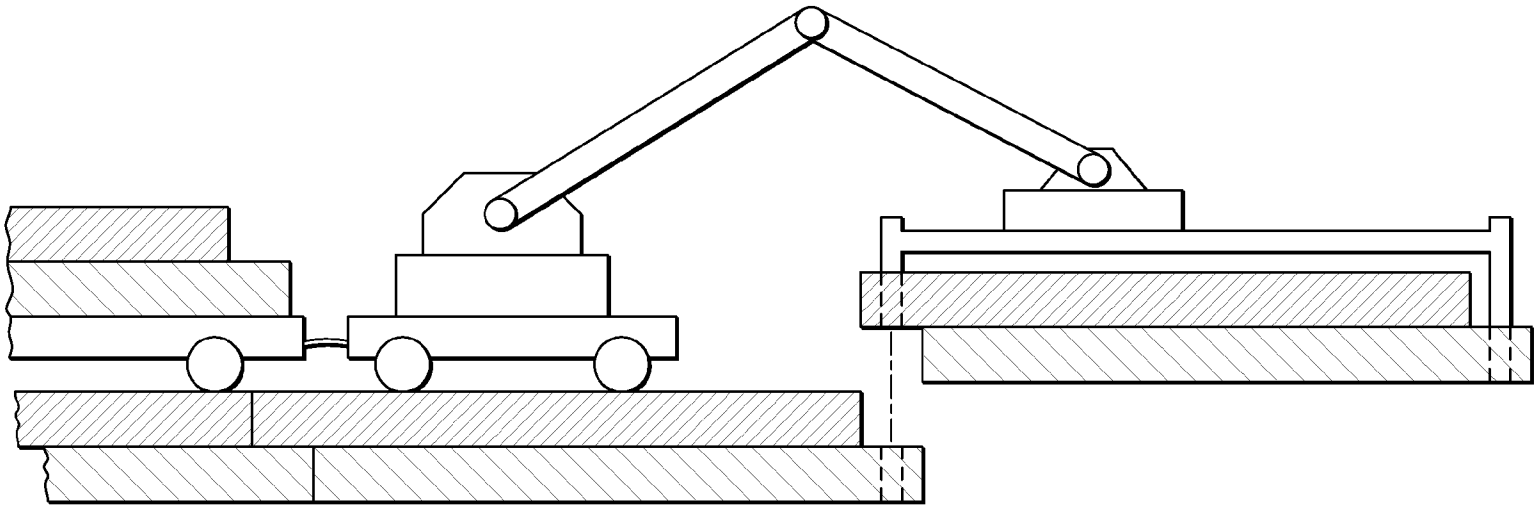
FIGS. 4 and 5 each show a side view of a crane placing a gripped mat into position next to an already positioned mat with the exemplary crane grab head.

From this dotted position, the operator then moves the exemplary jaws together via the cylinders 108*a*;108*b* such that the flange of each tooth overlaps the bottom ridge 15 of each hole 13 to grip and lift the mat as shown in FIG. 4.

From the dotted position, the operator alternatively may move the exemplary jaws apart, rather than bring them together, such that the outer face of each tooth makes contact with the outer edge of each hole 13. Moving the jaws outward provides an alternative way of gripping the mat.

In this embodiment, the crane operator then releases the teeth from engagement with the edges of the holes, using the cylinders, and returns the jaws to the dotted position shown in FIG. 3. From here, the crane operator then raises the crane grab head away from the newly positioned mat.

The two mats can then be secured together by a locking pin or any other fastening means.

The above process can then be repeated with a new mat as required.

In some instances, it may be that the crane operator wishes to place a mat alongside an already positioned mat which has a top sheet, rather than a bottom sheet, sticking out. In this case, the crane operator must slide the bottom sheet of the new mat underneath the top sheet of the already positioned mat to allow the two mats to be connected.

Figure 5:
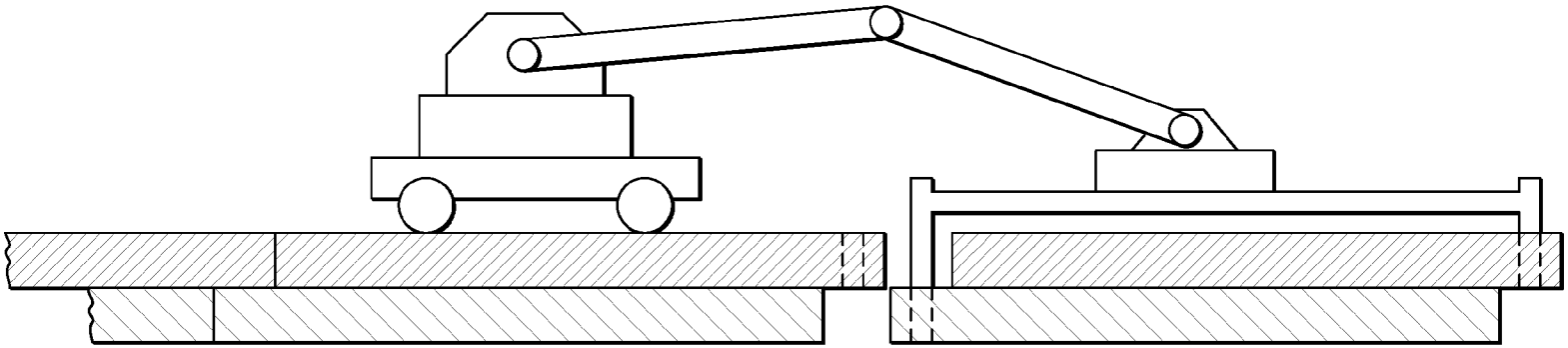

To slide the new mat underneath the already positioned mat, the operator first places the new mat next to the already placed mat as shown in FIG. 5. The operator then disconnects the second jaw from the mat, tilts the crane grab head from the new mat, and then expands the second jaw, which previously engaged with the pair of holes in the lower sheet of the new mat, such that it engages with the pair of holes in the upper sheet of the already placed mat. In this position, as the first and second jaws are each connected to a pair of holes in an upper sheet of a mat, the grab head may be slightly angled from the horizontal to compensate for the fact that the teeth of the second jaw are positioned slightly lower than the teeth from the first jaw.

Once both the jaws are engaged with their holes in the upper sheets of the mats, the operator pulls the jaws together using the cylinders 108*a*;108*b*. Since the weight of the crane is acting on the already placed mat, when the jaws are pulled together the new mat is the mat which moves. Thus the bottom sheet of the new mat slides underneath the top sheet from the already positioned mat and into a position for fastening.

In this embodiment, to separate the new mat from the already positioned mat after use, the previously described process may be reversed as follows:

i) the crane is positioned on the already placed mat as shown in FIG. 5. The grab head is then slightly angled from the horizontal such that the teeth from the second jaw are positioned in the holes of the upper sheet in the already placed mat and the teeth from the first jaw positioned in the holes of the upper sheet in the new mat;

ii) once both the jaws are engaged with their respective holes as in i), the operator then pushes the jaws apart using the cylinders 108*a*;108*b* such that the outer face of the teeth in the first jaw make contact with the outer edge of each hole 13. Since the weight of the crane is acting on the already placed mat, when the jaws are pushed apart the new mat slides laterally out from under the already placed mat (which remains stationary) into the position shown in FIG. 5;

iii) once the new mat is in the position shown in FIG. 5, the new mat is then lifted as previously described (by re-engaging the flange of each tooth with the bottom ridge 15 of each hole 13).

The ability to push two mats apart may be useful in situations other than the one described above, such as if two mats are stuck together.

Thus it will be appreciated that the outer side of each tooth can be used to separate two mats apart and the inner side of each tooth can be used to bring two mats together. However, only the inner side of each tooth, which comprises the flange which engages with the ridge in the mat, is used to lift the mat.

Whenever a mat is gripped, it is preferable to use hole set A-A, rather than B-B or C-C. As the holes in A-A are the most centrally located on the mat, gripping the mat with these holes reduces the bending forces exerted on the teeth when the mat is lifted.

In some embodiments of the grab head, one or both of the jaws may include a detachable adaptor. The adaptor includes a further tooth which is similar in shape to any of the other teeth previously described. The purpose of this auxiliary tooth is to take over the role of the teeth of the jaw to which the adaptor is fastened, such that the adaptor allows the separation between the auxiliary tooth and the teeth of the other jaw to be changed as compared to the separation between the teeth on the jaws without the adaptor in place.

The invention claimed is:

1. System for assembling a temporary surface with the use of a crane, the system comprising:

a plurality of mats configured to be placed on the ground and interconnected to form the temporary surface, each said mat being configured to withstand the load of a vehicle passing over it, each said mat having at least first, second, third and fourth spaced-apart holes extending therethrough and at least first and second sides opposite one another, each said mat further having a stepped-configuration that includes a first projection extending at least partially along at least said first side of said mat and a second projection extending at least partially along at least said second side of said mat, said first and second projections being offset height-wise relative to one another so that said first projection is lower than said second projection when said mat is upright, wherein said first and second holes are formed in said first projection and said third and fourth holes are formed in said second projection; and a grab head including a central portion engageable with the crane, at least first and second elongated telescoping supports extending linearly from and in opposite lateral directions relative to said central portion, each of said first and second supports having a central longitudinal axis, and a first jaw disposed proximate to the end of said first support opposite said central portion and a second jaw disposed proximate to the end of said second support opposite said central portion, each said jaw including at least first and second spaced-apart teeth extending downwardly therefrom, each said tooth of each said jaw having at least one flange projecting in the direction of the other said jaw, each said tooth of said first jaw being engageable with one among said first and second holes in said mat and, concurrently, each said tooth of said second jaw being engageable with one among said third and fourth holes in said mat, wherein, at least when said central longitudinal axis of said first and second supports is oriented generally horizontally, said flange of each said tooth of said first jaw is configured to be positioned farther downwardly relative to said central portion of said grab head than said flange of each said tooth of said second jaw, wherein when said teeth are engaged in said respective associated holes in said mat and said jaws are moved toward one another, said grab head is configured to selectively grab and lift said mat, position it on the ground adjacent to another said mat for interconnection therewith and release said mat.

2. The system of claim 1 wherein the distance between a horizontal plane passing through the top of said central portion and a parallel plane passing through the bottom of each said tooth is less than 9.84 inches.

3. The system of claim 1 wherein said grab head further includes at least one actuator configured to selectively and independently move each of said first and second jaws toward and away from said other jaw.

4. The system of claim 3 wherein said grab head further includes a pivot joint configured to selectively move said first and second jaws angularly and rotationally.

5. The system of claim 3 wherein said at least one actuator includes a first cylinder extending from said central portion in the same direction as said first support and engaged with said first jaw and a second cylinder extending from said central portion in the same direction of said second support and engaged with said second jaw.

6. The system of claim 5 wherein each said cylinder has a circular cross-section.

7. The system of claim 5 wherein said grab head further includes a third said elongated telescoping support extending from said central portion in the same direction as said first support and engaged with said first jaw, and a fourth said elongated telescoping support extending from said central portion in the same direction as said second support and engaged with said second jaw.

8. The system of claim 7 wherein said first cylinder is parallel to and disposed between said first and third supports said second cylinder is parallel to and disposed between said second and fourth supports.

9. The system of claim 1 wherein said first and second jaws are selectively moveable toward and away from one another with equal force, further wherein when first and second said mats are positioned adjacent to one another on the ground, said first and second teeth of said first jaw are configured to engage a pair of said holes in said first mat, said first and second teeth of said second jaw are configured to engage a pair of said holes in said second mat and said first and second jaws are configured to be movable away from one another sufficient to push apart said first and second mats.

10. The system of claim 1 wherein at least one among said first and second jaws includes a visual indication that visually distinguishes it from said other jaw.

11. The system of claim 1 wherein each said mat includes a shoulder surrounding each said hole formed therein, further wherein said flange of each said tooth is configured to engage said shoulder of said associated respective hole when said first and second jaws are moved toward one another.

12. System for assembling a temporary surface with the use of a crane, the system comprising:

a plurality of stepped mats configured to be placed on the ground and interconnected to form the temporary surface, each said mat having at least first and second sides opposite one another, an upper projection extending at least partially along said first side and a lower projection extending at least partially along said second side, said upper and lower projections being offset relative to one another so that said upper projection is higher than said lower projection, each said mat also having at least first, second, third and fourth spaced-apart holes extending therethrough, said first and second holes being formed in said upper projection and said third and fourth holes being formed in said lower projection; and a grab head including a central portion engageable with the crane, and first and second jaws disposed on opposite sides of said central portion and being selectively moveable toward and away from one another, each said jaw including at least first and second spaced-apart teeth extending downwardly therefrom, each said tooth of said first jaw being engageable with one among said first and second holes in said mat and, concurrently, each said tooth of said second jaw being engageable with one among said third and fourth holes in said mat, each said tooth of each said jaw having at least one flange projecting in the direction of the other said jaw, wherein when a central longitudinal axis of said central portion is oriented generally horizontally, said flange of each said tooth of said second jaw is configured to be positioned farther downwardly relative to said central portion than said flange of each said tooth of said first jaw to accommodate engagement and lifting of said stepped mat by said grab head.

13. The system of claim 12 wherein the distance between a horizontal plane passing through the top of said central portion and a parallel plane passing through the bottom of the lowermost said flange of said teeth is less than 9.84 inches.

14. The system of claim 12 wherein said grab head further includes first and second cylinders configured to selectively and independently move said first and second respective jaws toward and away from one another, said first cylinder extending from said central portion in one direction and engaged with said first jaw and said second cylinder extending from said central portion in the opposite direction and engaged with said second jaw, wherein each said cylinder has a circular cross-section.

15. The system of claim 12 wherein said first and second jaws are selectively moveable toward and away from one another with equal force.

16. The system of claim 12 wherein at least one among said first and second jaws includes a visual indication that visually distinguishes it from said other jaw.

17. The system of claim 12 wherein said grab head further includes a pivot joint configured to move said first and second jaws angularly and rotationally.

18. The system of claim 12 wherein each said mat includes a shoulder surrounding each said hole formed therein, further wherein said flange of each said tooth engages said shoulder of said associated respective hole.

19. The system of claim 12 wherein each said mat is configured to withstand the load of a vehicle passing over it.

* * * * *